US006536648B2

(12) United States Patent
Flannery et al.

(10) Patent No.: US 6,536,648 B2
(45) **Date of Patent: *Mar. 25, 2003**

(54) SYSTEM FOR DISPENSING PLASTIC FASTENERS

(75) Inventors: Steven E. Flannery, Southborough, MA (US); William J. Cooper, Woonsocket, RI (US)

(73) Assignee: Avery Dennison Corporation, Pasadena, CA (US)

( * ) Notice: Subject to any disclaimer, the term of this patent is extended or adjusted under 35 U.S.C. 154(b) by 62 days.

This patent is subject to a terminal disclaimer.

(21) Appl. No.: 09/812,530

(22) Filed: Mar. 20, 2001

(65) Prior Publication Data

US 2002/0134810 A1 Sep. 26, 2002

(51) Int. Cl.[7] ..... B65C 7/00
(52) U.S. Cl. ..... 227/67; 227/140
(58) Field of Search ..... 227/67, 76, 140, 227/156; 15/192, 193, 176.4; 83/941

(56) References Cited

U.S. PATENT DOCUMENTS

| | | | | | |
|---|---|---|---|---|---|
| 133,966 | A | | 12/1872 | Lightenhome | |
| 2,303,800 | A | * | 12/1942 | Swann | 15/192 |
| 2,326,811 | A | * | 8/1943 | Wiggam et al. | 15/193 |
| 3,734,375 | A | | 5/1973 | Bone et al. | |
| 4,039,078 | A | | 8/1977 | Bone | |
| 4,288,017 | A | | 9/1981 | Russell | |
| 5,092,829 | A | * | 3/1992 | Gerber | 227/67 |
| 5,189,936 | A | * | 3/1993 | Gerber et al. | 83/941 |
| 5,433,366 | A | | 7/1995 | Deschenes et al. | |
| 5,615,816 | A | | 4/1997 | Deschenes et al. | |
| 5,950,901 | A | * | 9/1999 | Kubota | 227/67 |
| 6,244,490 | B1 | * | 6/2001 | Flannery et al. | 227/67 |

* cited by examiner

*Primary Examiner*—Scott A. Smith
(74) *Attorney, Agent, or Firm*—Kriegsman & Kriegsman

(57) ABSTRACT

A system for coupling two or more items with a plastic fastener includes a device for dispensing the plastic fastener and an anvil adapted to support the two or more items to be coupled by the plastic fastener. In one embodiment, the anvil comprises a support block and a plurality of tufts of filaments fixed to the support block. The support block is constructed of polyvinyl chloride (PVC) and includes a flat top surface. A plurality of holes are formed into the top surface, each hole being circular in lateral cross-section with a diameter of approximately 0.098 inches. Each hole formed in the top surface of the support block is adapted to receive a corresponding tuft of filaments. Each filament is constructed of nylon and is circular in lateral cross-section with a diameter of approximately 0.018 inches.

17 Claims, 5 Drawing Sheets

SYSTEM FOR DISPENSING PLASTIC FASTENERS

BACKGROUND OF THE INVENTION

The present invention relates generally to plastic fasteners and more particularly to devices used in the dispensing of plastic fasteners.

In U.S. Pat. No. 4,039,078 to A. R. Bone, which is incorporated herein by reference, there are disclosed several different types of plastic fasteners, or attachments, which are fabricated as part of continuously connected ladder stock. In each instance, the fastener has an H-shape, and the ladder stock is formed from two elongated and continuous plastic side members coupled together by a plurality of plastic cross links, the cross links preferably being equidistantly spaced. The stock may be produced from flexible plastics material including nylon, polypropylene and other similar materials by molding or by stamping.

Either manually or with the aid of specifically designed devices, individual fasteners may be dispensed from the ladder stock to couple buttons to fabric, merchandising tags to articles of commerce, or, in general, any two desired articles. In those instances where the dispensing device has dual needles, the attachments severed from the stock can be used like staples to secure objects and items.

Devices for dispensing plastic fasteners are well known in the art. Plastic fastener dispensing devices are commonly used to sever individual plastic fasteners from continuously connected ladder stock and to attach such individual plastic fasteners to items.

In commonly assigned U.S. Pat. No. 5,615,816, which is incorporated herein by reference, there is disclosed an apparatus for dispensing attachments from continuously connected ladder stock of the type comprising a pair of plastic side members coupled together by a plurality of plastic cross links. The apparatus includes a mount, a support movably mounted on the mount, and a pair of carrier blocks mounted on the support. A needle block is mounted on each carrier block and a hollow, slotted needle is mounted on each needle block. A feed mechanism including a pair of feed wheels, is mounted on said support for advancing the ladder stock into the hollow slotted needles and a pair feed tracks, one for each hollow slotted needle, are provided through which the ladder stock passes from the feed wheels into the pair of hollow slotted needles. A pair of knives are provided for severing an attachment from the ladder stock, and a pair of ejector rods are provided for ejecting the severed attachment through the hollow slotted needles. The carrier blocks are disposed parallel to each other and movable sideways relative to each other so that the spacing between the hollow slotted needles can be changed for different applications and the feed wheels are disposed parallel to each other and movable sideways relative to each other so that their spacing can be changed to accommodate different widths of ladder stock. In order to provide a path for the ladder stock form the feed wheels to the hollow slotted needles for different feed wheel spacings and/or needle spacings, each feed track assembly includes a pivotally mounted section.

The apparatus disclosed in U.S. Pat. No. 5,615,816 is well known in the art and is commonly referred to simply as a variable needle system (VNS). As can be appreciated, the variable needle system disclosed in U.S. Pat. No. 5,615,816 suffers from a notable drawback. Specifically, in use, the user is required to manually urge the items to be coupled against the pair of needles in such a manner so that the pair of needles penetrates through the items. As a result, it has been found that the user is at risk of inadvertently contacting the sharpened end of the needles, which is highly undesirable.

In U.S. Pat. No. 5,433,366 to C. L. Deschenes, which is incorporated herein by reference, there is disclosed a device for dispensing plastic attachments of the type which are formed as part of a roll of continuously connected ladder stock. In one embodiment, the device includes a pair of hollow slotted needles each having a tip, a rear end and a longitudinal axis. A feed wheel, placed proximate to the rear ends of the pair of needles, is used to feed individual attachments of a roll of ladder stock into the pair of needles through their respective rear ends at angles relative to the longitudinal axes thereof. Once inserted into the needles, an attachment is severed from the remainder of the ladder stock by a knife and is then expelled from the needles by a pair of ejector rods movable along the longitudinal axes of the pair of needles. Because attachments are fed into the pair of needles at angles relative to their longitudinal axes, no shuttling of the needles between an attachment feeding position and an attachment ejecting position is required. The pair of needles, the feed wheel, the knife, and the pair of ejector rods are all mounted on a vertically movable head member. An electric motor assembly is used to move the head member between an attachment dispensing position and a withdrawal position. The vertical movement of the head member drives the operation of the feed wheel, the knife and the ejector rods.

The device described in U.S. Pat. No. 5,433,366 includes a frame which includes a base, a neck, a housing, and an arm onto which a reactor plate is mounted. It should be noted that the reactor plate for the device described in U.S. Pat. No. 5,433,366 serves as a support surface, or anvil, on which the items to be coupled by a plastic fastener are placed. The reactor plate typically includes a top surface, a bottom surface and a pair of openings formed in the top surface. The openings are typically circular in lateral cross-section and are relatively small in size (approximately 0.25 inches in diameter).

In use, the items to be attached by a plastic fastener using the device described above are placed on the reactor plate. Activation of the crank arm drives each hollow slotted needle down through the items to be attached and into an associated opening formed in the top surface of the reactor plate. With each needle disposed through the items and into its associated opening in the reactor plate, further activation of the crank arm downwardly projects an ejector rod which is disposed inside the hollow needle. Downward projection of the ejector rod urges a cross-bar of the plastic fastener through the articles to be coupled, thereby securing the articles together.

Although devices of the type described in U.S. Pat. No. 5,433,366 have performed reasonably well in dispensing plastic fasteners, it has been found that these types of devices often experience two notable drawbacks.

As a first drawback, it has been found that, on occasion, the reactor plate provides inadequate support during the process of coupling together the desired articles. Specifically, it has been found that, as each needle is attempting to pierce through the items during the coupling process, articles which are manufactured out of a thin material are often pushed down into its associated opening in the reactor plate by the needle. As a result, the needle is unable to pierce all the way through the items, thereby preventing the device from properly coupling the desired articles with a plastic fastener, which is highly undesirable.

As a second drawback, it has been found that, on occasion, each needle does not properly align itself down into its associated opening formed in the reactor plate. Specifically, as the needle is displaced downward through the items, the fabric, or weave, of the items often bends, or attenuates, the needle, thereby displacing the needle laterally. As a consequence, the needle is often misaligned and, accordingly, will abut against the top surface of the reactor plate rather than project down into the relatively small opening in the reactor plate, thereby preventing the device from properly coupling the desired articles with a plastic fastener, which is highly undesirable.

SUMMARY OF THE INVENTION

It is an object of the present invention to provide a new and improved system for coupling two or more items with a plastic fastener.

It is another object of the present invention to provide a system for coupling two or more items with a plastic fastener which has a limited number of parts, which is easy to use and which is inexpensive to manufacture.

Accordingly, as one feature of the present invention, there is provided a system for coupling two or more items with a plastic fastener, said system comprising a device for dispensing the plastic fastener, said device comprising at least one hollowed needle, and an anvil adapted to support the two or more items to be coupled by the plastic fastener, said anvil comprising a plurality of filaments. brush anvil adapted to support two or more items to be coupled by a plastic fastener, said brush anvil comprising a plurality of filaments.

As another feature of the present invention, there is provided a system for coupling two or more items with a plastic fastener, said system comprising a device for dispensing the plastic fastener, said device comprising at least one hollowed needle, and an anvil adapted to support the two or more items to be coupled by the plastic fastener, said anvil comprising a first tuft of filaments and a second tuft of filaments.

As another feature of the present invention, there is provided a method of coupling two or more items with a plastic fastener, comprising the steps of providing an anvil comprising a plurality of filaments, disposing the two or more items on said anvil, and coupling the two or more items using a device for dispensing the plastic fastener, the device for dispensing the plastic fastener comprising at least one hollowed needle.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
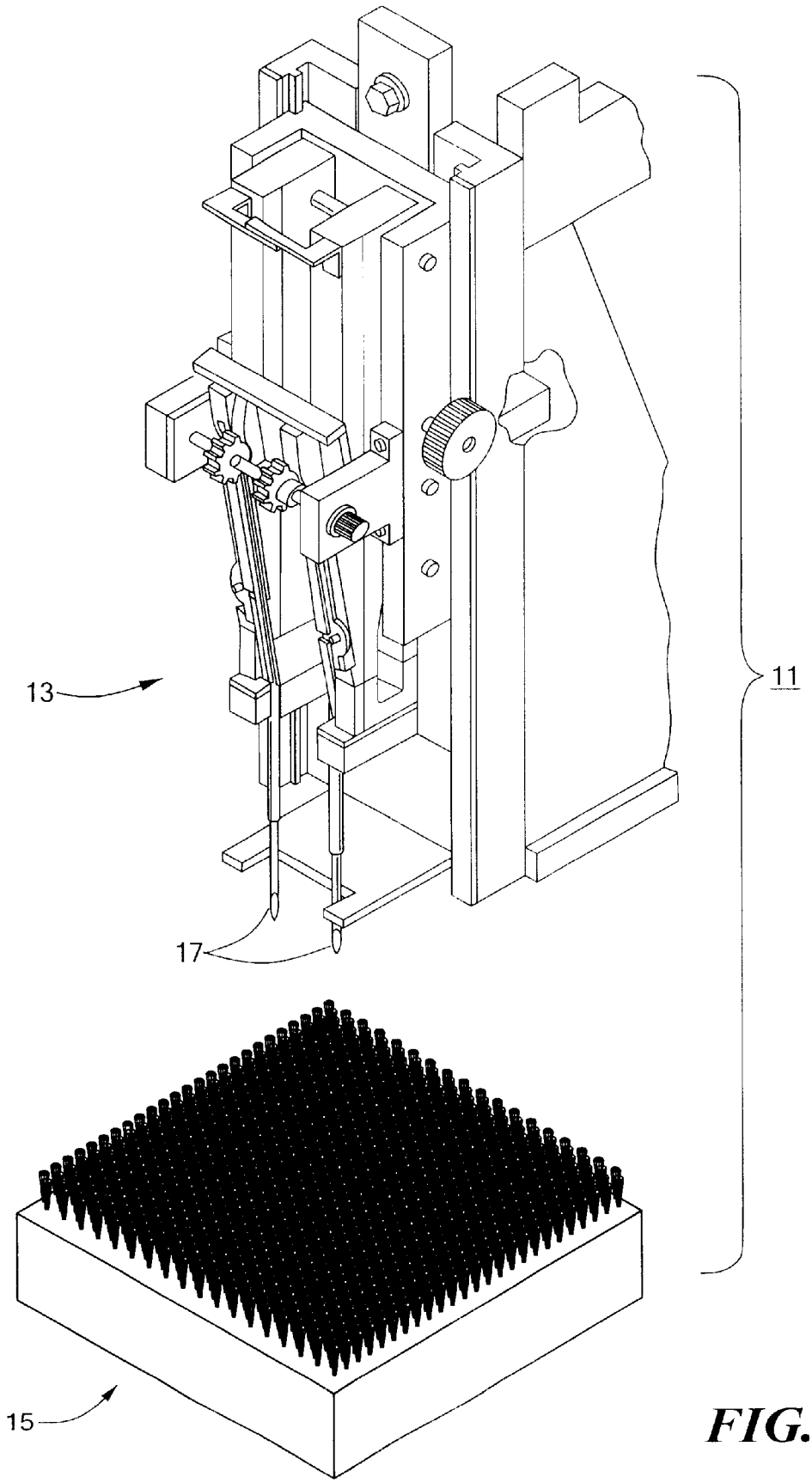
FIG. 1 is a top perspective view of a system constructed according to the teachings of the present invention for coupling two or more items with a plastic fastener.
Figure 2:
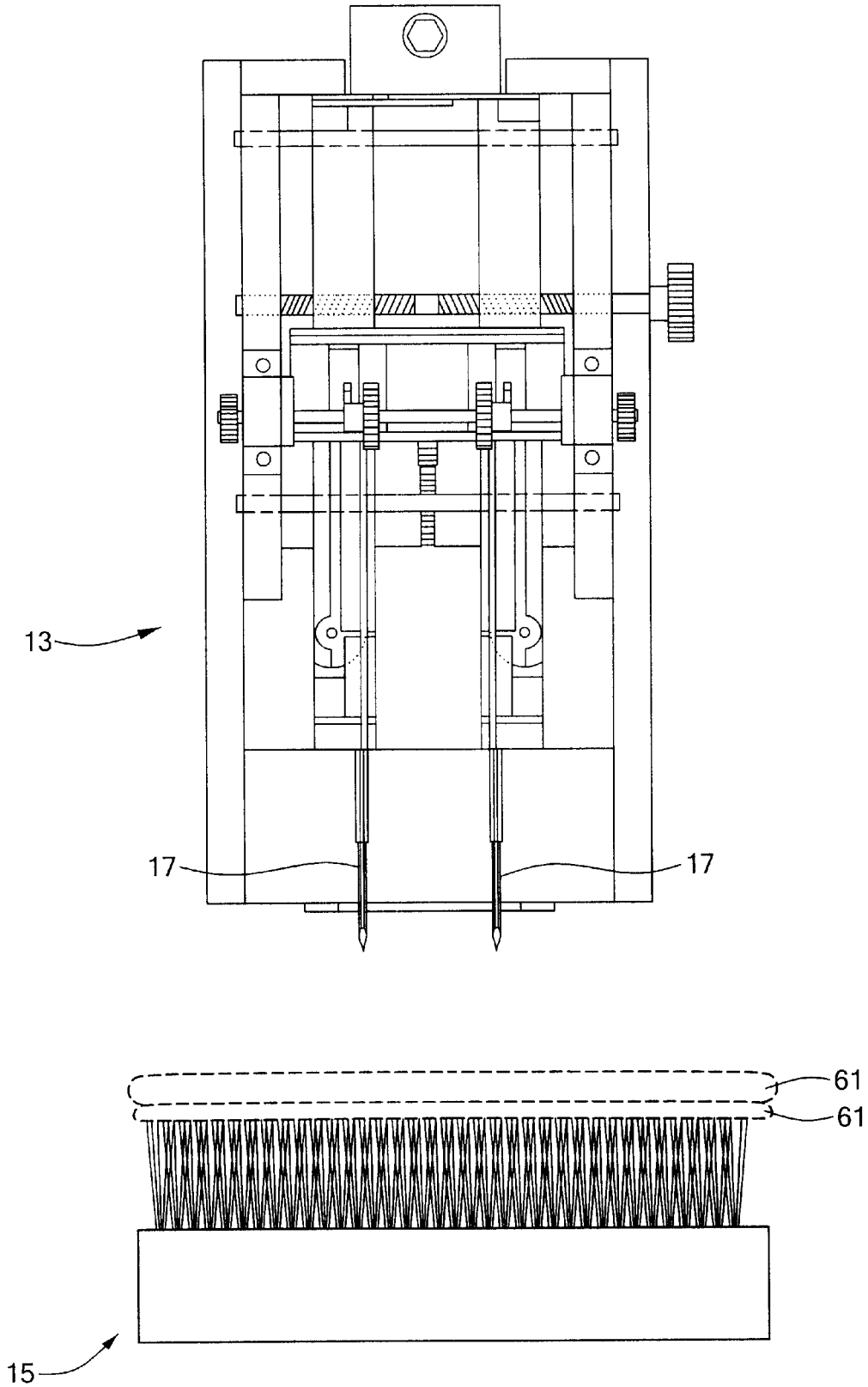
FIG. 2 is a front plan view of the system shown in FIG. 1, the system being shown with the anvil supporting a pair of items to be coupled with a plastic fastener, the pair of items being shown in phantom.

Referring now to FIGS. 1 and 2, there is shown a system constructed according to the teachings of the present invention for coupling two or more items with a plastic fastener, the system being identified generally as reference numeral 11.

System 11 comprises a device 13 for dispensing the plastic fastener and an anvil 15 for supporting the two or items to be coupled by the plastic fastener.

Device 13 represents any well known device for dispensing plastic fasteners which includes one or more sharpened needles 17. As an example, device 13 may be of the type described in U.S. Pat. No. 5,615,816 to C. L. Deschenes , et al. As another example, device 13 may be of the type described in U.S. Pat. No. 5,433,366 to C. L. Deschenes et al. As another example, device 13 may be a handheld tagger gun of the type described in U.S. Pat. No. 4,288,017 to D. B. Russell.

Figure 3:
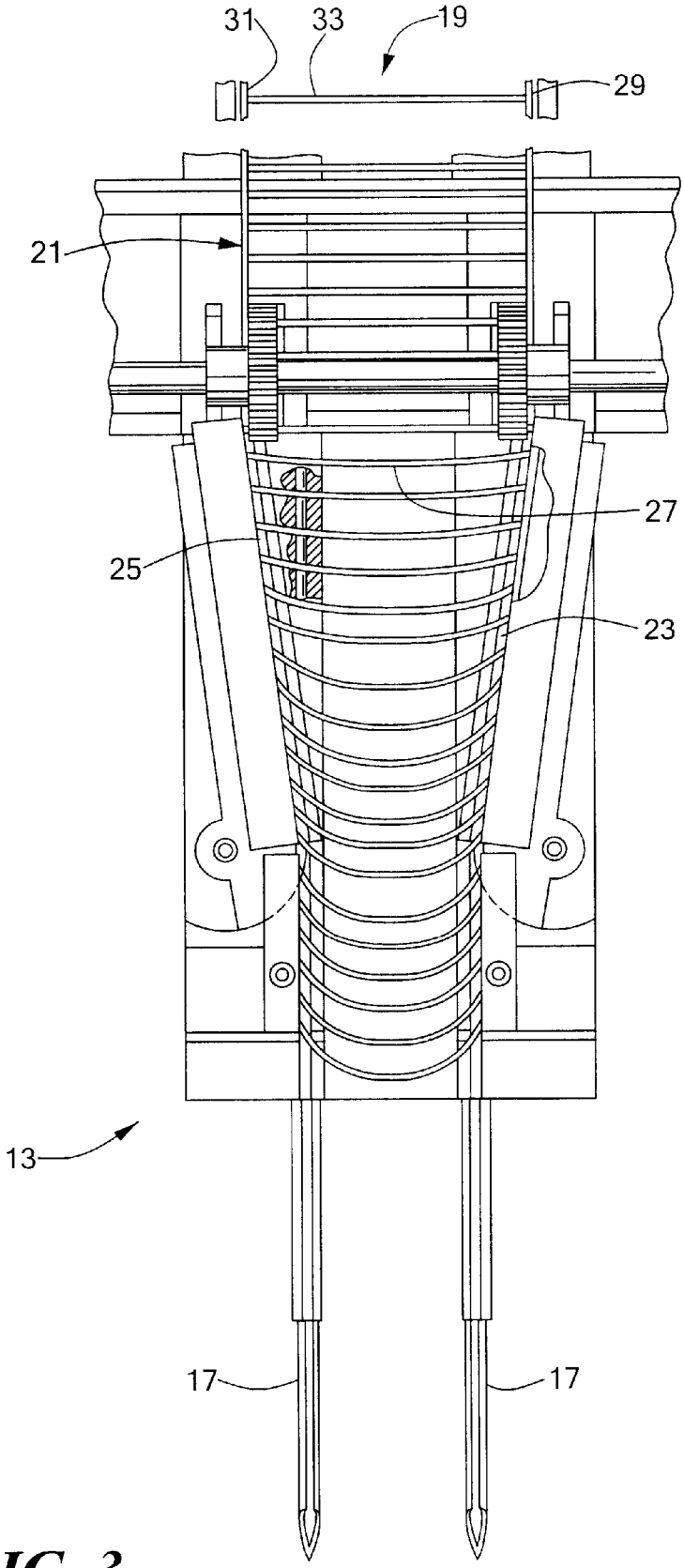
FIG. 3 is an enlarged, fragmentary, front plan view of the device for dispensing plastic fasteners shown in FIG. 1, the device being shown with a continuous supply of plastic fasteners fed therethrough for dispensing.

Device 13 is preferably of the type which can be used to dispense fasteners 19 from continuously connected ladder stock 21. Specifically, referring now to FIG. 3, ladder stock 21 is preferably made of plastic and comprises a pair of side members 23 and 25 interconnected by a plurality of cross links 27. A fastener 19 which is obtained from ladder stock 21 comprises a pair of end bars 29 and 31 interconnected by a filament 33 with end bars 29 and 31 comprising sections of side members 23 and 25, respectively, and filament 33 comprising a cross link 27.

Figure 4:
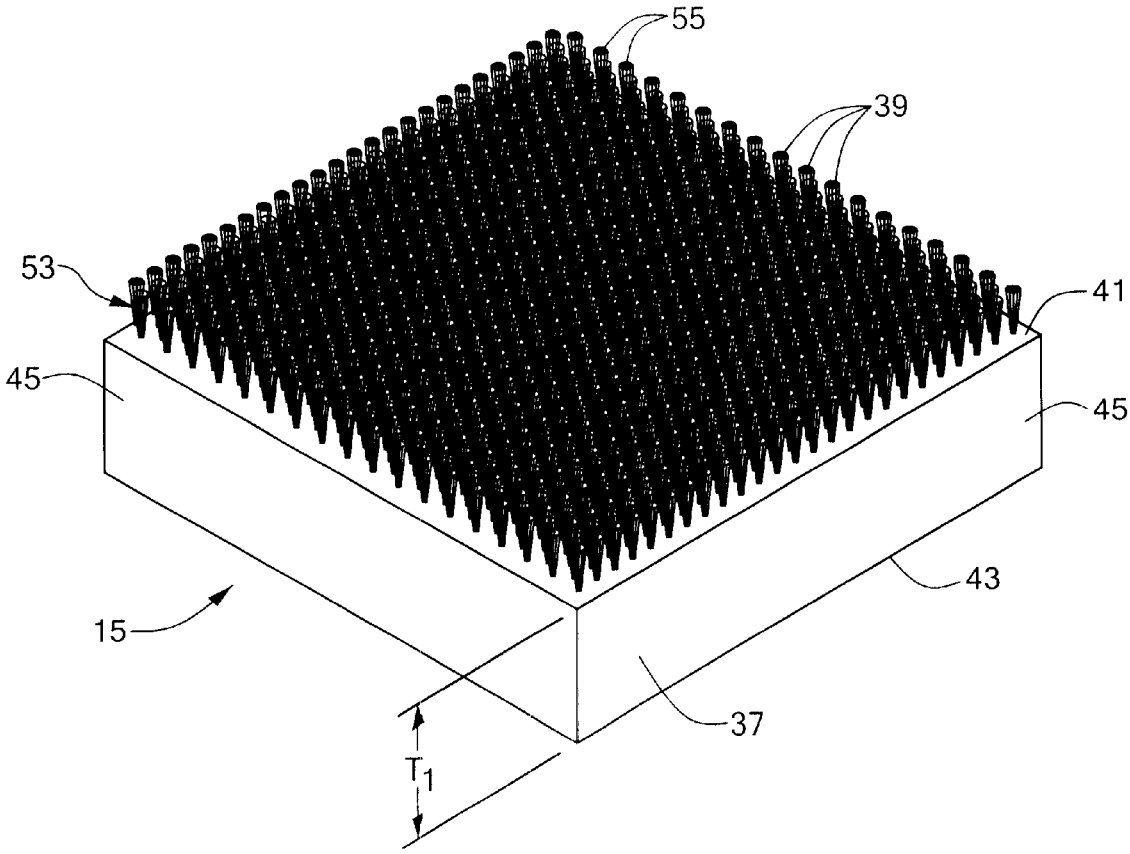
FIG. 4 is a top perspective view of the anvil shown in FIG. 1.
Figure 5:
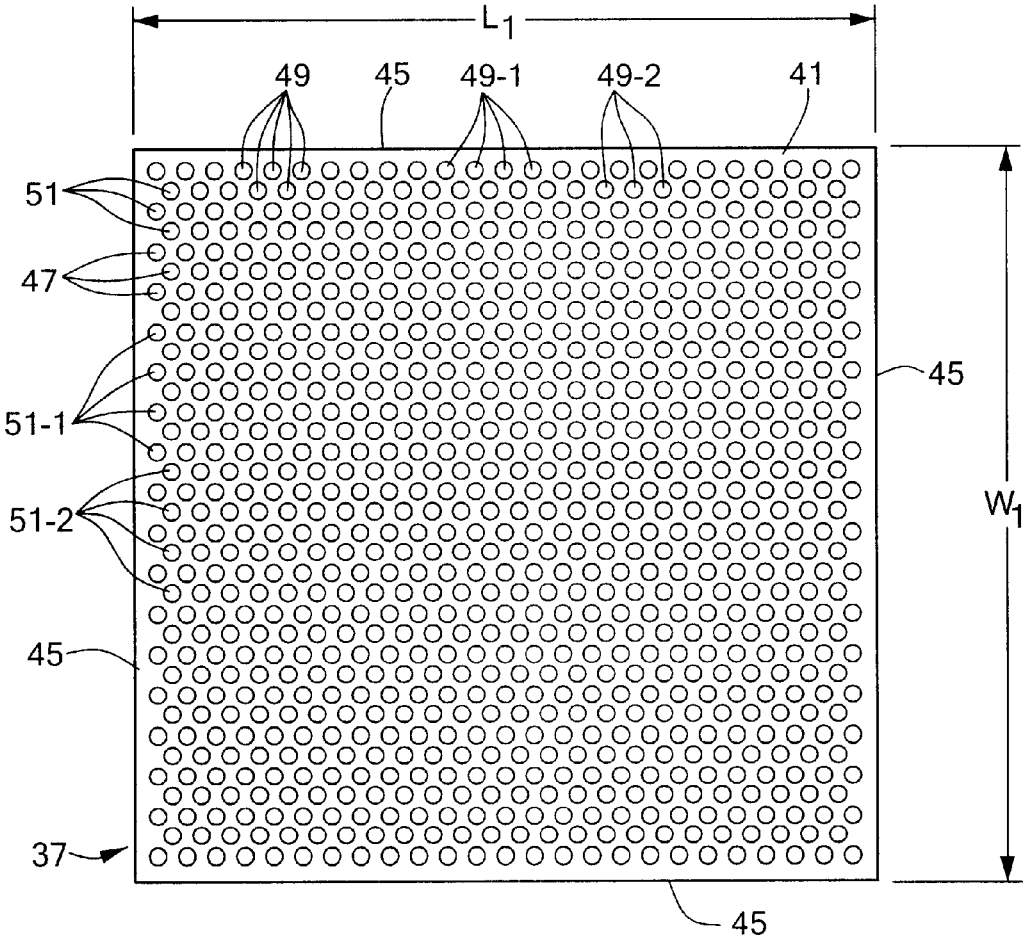
FIG. 5 is a top plan view of the support block shown in FIG. 4.
Figure 6:
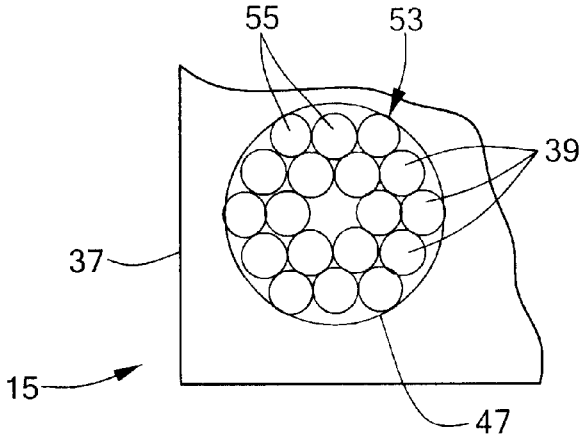
FIG. 6 is an enlarged, fragmentary, top plan view of the anvil shown in FIG. 4 is a rear plan view of the brush anvil shown in FIG. 1, the brush anvil being shown supporting a pair of items which are to be coupled by a device for dispensing plastic fasteners, the pair of items and the device for dispensing plastic fasteners being shown in phantom.

Referring now to FIGS. 4–6, anvil 15 comprises a support block 37 and a plurality of filaments 39 disposed into support block 37.

Support block 37 comprises a substantially flat top surface 41, a substantially flat bottom surface 43 and four sidewalls 45. Support block 37 has a length $L_1$ of approximately 4.0 inches, a width $W_1$ of approximately 4.0 inches and a thickness $T_1$ of approximately 0.75 inches.

Support block 37 is preferably constructed out of polyvinyl chloride (PVC). However, it is to be understood that support block 37 could be constructed out of alternative materials which have rigid and durable characteristics, such as different types of plastics, without departing from the spirit of the present invention.

Referring now to FIG. 5, a plurality of openings 47 are formed into top surface 41 of support block 37 and extend down a portion of the distance from top surface 41 towards bottom surface 43. Each opening 47 is generally circular in lateral cross-section with a diameter of approximately 0.098 inches. As will be described further in detail below, a tuft of brush filaments 39 is disposed into each opening 47 to form anvil 15.

Preferably, support block 37 is shaped to include eight hundred fifty-eight openings 47 which are configured into a plurality of parallel columns, as represented by reference numeral 49, and a plurality of parallel rows, as represented by reference numeral 51. Specifically, support block 37 is shaped to include twenty-five major columns 49-1 which alternate with twenty-four minor columns 49-2, successive major columns 49-1 being spaced approximately 0.156 inches apart. In addition, support block 37 is shaped to include eighteen major rows 51-1 which alternate with seventeen minor rows 51-2, successive major rows 51-1 being spaced approximately 0.221 inches apart.

It should be noted that support block 37 is not limited to the particular number and configuration of openings 47 described above. Rather, it is to be understood that support block 37 could include alternative numbers of openings 47 or could arrange openings 47 in alternative configurations without departing from the spirit of the present invention.

A tuft 53 of filaments 39 is disposed into each opening 47, as shown in FIG. 6. Each tuft 53 represents a bundle, or cluster, of approximately eighteen filaments 39. However, it is to be understood that each tuft 53 could comprise alternative numbers of filaments 39 without departing from the spirit of the present invention.

Each filament 39 is preferably constructed of nylon. However, it is to be understood that filaments 39 need not be limited to nylon. Rather, filaments 39 could be constructed of alternative materials, such as other types of plastics having a stiffness similar to nylon, without departing from the spirit of the present invention.

Each filament 39 is generally circular in lateral cross-section and has a diameter of approximately 0.018. It should be noted that the relatively thin diameter of filaments 39 enables needles 17 of device 13 to easily project down between filaments 39, which is highly desirable.

Each tuft 53 of filaments 39 is retained within support block 37 by lining its associated opening 47 with an adhesive, such as epoxy. However, it is to be understood that anvil 15 is not limited to the use of an adhesive to retain each tuft 53 within its associated opening 47. Rather, each tuft 53 could be retained within its associated opening 47 by alternative means, such as by fittingly disposing each tuft 53 of filaments 39 into its associated opening 47, without departing from the spirit of the present invention.

Each filament 39 includes a free end 55. Filaments 39 are disposed into support block 37 in such a manner that free end 55 of each filament 39 is spaced approximately 0.7 inches away from top surface 41.

Accordingly, system 11 can be used in the following manner. Specifically, in use, two or more items 61 which are to be fastened together are disposed onto free end 55 of filaments 39. With items 61 disposed as such, hollow needles 17 of device 13 are projected through items 61 and down between filaments 39. With hollow needles 17 disposed through items 61, device 13 ejects the pair of end bars 29 and 31 of an individual plastic fastener 19 out through hollow needles 17, thereby fastening items 61 together.

It should be noted that the particular density of filaments 39 in anvil 15 (i.e., the type and size of individual filaments 39, the number of filaments 39 per tuft 53, and the spacing between tufts 53) creates numerous advantages.

As a first advantage, the particular density of filaments 39 in anvil 15 is such that needles 17 of device 13 can easily penetrate between filaments 39. Specifically, it should be noted that, if a needle 17 pierces through items 61 and projects down onto free end 55 of an individual filament 39, the downward force of needle 17 will bend and laterally displace the individual filament 39 an adequate distance so that needle 17 can protrude down between filaments 39. Due to the resiliency in their construction, filaments 39 return to their original position upon withdrawal of needles 17 from within anvil 15, which is highly desirable.

As a second advantage, the particular density of filaments 39 in anvil 15 is such that anvil 15 acts as a support that is strong enough to hold items 61 when fastened together. Specifically, because filaments 39 are constructed out of a strong nylon material and are disposed in a high density configuration, anvil 15 provides a strong enough support for items 61 so as to allow hollow needles 17 to easily pierce through items 61 during the fastening process, which is highly desirable. In addition, because filaments 39 are disposed in a high density configuration, the material of items 61 will not be forced between filaments 39, thereby precluding penetration of needles 17 through items 61, which is highly desirable.

As a third advantage, the particular density of filaments 39 in anvil is such that end bars 29 and 31 of the dispensed fastener 19 will not toggle out within filaments 39, thereby causing fastener 19 to attach itself to anvil 15. Specifically, end bars 29 and 31 of the dispensed fastener 19, upon ejection from device 13, are disposed in a substantially vertical position between filaments 39. Accordingly, it is important to note that the particular density of filaments 39 is such that end bars 29 and 31 will not toggle into a substantially horizontal position between filaments 39, thereby disposing end bars 29 and 31 in a perpendicular relationship with the filaments. As can be appreciated, if end bars 29 and 31 toggle into a substantially horizontal position between filaments 39, there is a risk of one of end bars 29 and 31 anchoring, or engaging, filaments 39, which is highly undesirable. As a result, anvil 15 is constructed so that, as each needle 17 projects between filaments 39, needle 17 serves to create an adequate space between filaments 39 so that end bars 29 and 31 of the ejected plastic fastener 19 will be able to protrude out from needle 17 and slide out from between filaments 39 without engaging any individual filament 39.

It should also be noted that anvil 15 may be used in different capacities.

As one example, anvil 15 may be fixedly mounted onto a support surface, such as a table, by any conventional means. Specifically, anvil 15 may be screwed onto the support surface, clamped onto the support surface, or secured onto the support surface using an adhesive, such as glue.

As another example, anvil 15 may be fixedly mounted onto a component of fastener dispensing device 13, such as a reactor plate, by any conventional means. Specifically, anvil 15 may be screwed onto a component of device 13, clamped onto a component of device 13, or secured onto a component of device 13 using an adhesive, such as glue.

As another example, anvil 15 may be secured onto the hand of a worker. Specifically, anvil 15 may be secured onto the hand of a worker using a strap.

It should further be noted that anvil 15 is not limited to the use of support block 37 to retain tufts 53 of filaments 39 in their desired configuration. Rather, it is to be understood that anvil 15 could be alternatively constructed without support block 37 without departing from the spirit of the present invention. As an example, rather than using support block 37 to hold tufts 53 of filaments 39, one end of tufts 53 could be coupled together by an adhesive, such as glue, without departing from the spirit of the present invention. As another example, rather than using support block 37 to hold tufts 53 of filaments 39, one end of tufts 53 could be coupled together by a string, or other similar device, without departing from the spirit of the present invention.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A system for coupling two or more items with a plastic fastener, said system comprising:

(a) a device for dispensing the plastic fastener, said device comprising at least one hollowed needle, and (a) an anvil adapted to support the two or more items to be coupled by the plastic fastener, said anvil comprising a plurality of filaments.

2. The system of claim 1 wherein said anvil comprises a plurality of tufts of filaments.

3. The system of claim 2 wherein said anvil comprises a block, said plurality of tufts of filaments being fixed to said block and extending upward substantially vertically from said block.

4. The system of claim 3 wherein said block is shaped to include a plurality openings, each opening being sized and shaped to receive a tuft of said filaments.

5. The system of claim 4 wherein each opening formed in said block is generally circular in lateral cross-section with a diameter of approximately 0.098 inches.

6. The system of claim 2 wherein said anvil comprises a high density of said tufts of filaments.

7. The system of claim 6 wherein each of said filaments in said tufts of filaments is constructed of nylon.

8. The system of claim 7 wherein each of said filaments in said tufts of filaments is generally circular in lateral cross-section with a diameter of approximately 0.018 inches.

9. A system for coupling two or more items with a plastic fastener, said system comprising:

(a) a device for dispensing the plastic fastener, said device comprising at least one hollowed needle, and (a) an anvil adapted to support the two or more items to be coupled by the plastic fastener, said anvil comprising a first tuft of filaments and a second tuft of filaments.

10. The system of claim 9 further comprising a block which is adapted to hold said first tuft of filaments and said second tuft of filaments.

11. The system of claim 10 wherein said block is shaped to include a first opening sized and shaped to receive said first tuft of filaments and a second opening sized and shaped to receive said second tuft of filaments.

12. The system of claim 11 wherein each of said first and second openings in said block is generally circular in lateral cross-section with a diameter of approximately 0.098 inches.

13. The system of claim 9 wherein each of said first and second tufts of filaments comprises a high density of filaments.

14. The system of claim 13 wherein each of said filaments is constructed of nylon.

15. The system of claim 14 wherein each of said filaments is generally circular in lateral cross-section with a diameter of approximately 0.018 inches.

16. The system of claim 15 wherein each of said first and second tufts comprises approximately eighteen filaments.

17. A method of coupling two or more items with a plastic fastener, comprising the steps of:

(a) providing an anvil comprising a plurality of filaments, (b) disposing the two or more items on said anvil, and (c) coupling the two or more items using a device for dispensing the plastic fastener, the device for dispensing the plastic fastener comprising at least one hollowed needle.

* * * * *